US006742665B2

(12) United States Patent
Lombardo

(10) Patent No.: US 6,742,665 B2
(45) Date of Patent: Jun. 1, 2004

(54) NURSING BOTTLE WITH VENT

(76) Inventor: Lori Lombardo, 4974 N. Plaza Dr., Apache Jct, AZ (US) 85220

( * ) Notice: Subject to any disclaimer, the term of this patent is extended or adjusted under 35 U.S.C. 154(b) by 0 days.

(21) Appl. No.: 10/113,685

(22) Filed: Apr. 2, 2002

(65) Prior Publication Data

US 2003/0183596 A1 Oct. 2, 2003

(51) Int. Cl.[7] ..... A61J 9/04
(52) U.S. Cl. ..... 215/11.15; 606/236
(58) Field of Search ..... 215/11.5, 11.4, 215/11.1, 2, 5, 18, 19; 606/234–236; 137/540, 541, 542; 251/320, 321, 336, 337

(56) References Cited

U.S. PATENT DOCUMENTS

| | | | | | |
|---|---|---|---|---|---|
| 297,174 | A | * | 4/1884 | Seymour | 215/378 |
| 533,726 | A | | 2/1895 | McBride | |
| 581,814 | A | * | 5/1897 | Durkin et al. | 215/378 |
| 1,045,456 | A | | 11/1912 | Tatum | |
| 1,827,100 | A | * | 10/1931 | Pardee | 215/11.5 |
| 1,976,450 | A | | 10/1934 | Lowe et al. | |
| 2,066,445 | A | | 1/1937 | Allen | |
| 2,084,099 | A | * | 6/1937 | Maccoy | 137/43 |
| 2,094,721 | A | | 10/1937 | Puetz | |
| 2,529,794 | A | * | 11/1950 | Brown | 215/11.5 |
| 3,043,462 | A | * | 7/1962 | Brill, Jr. et al. | 215/11.1 |
| 3,071,272 | A | | 1/1963 | Doner | |
| 3,130,725 | A | | 4/1964 | Griesinger | |
| 3,232,466 | A | | 2/1966 | Turanciol | |
| 3,292,808 | A | * | 12/1966 | Greene | 215/11.5 |
| 3,424,157 | A | | 1/1969 | Paolo | |
| 3,768,683 | A | * | 10/1973 | Van Den Bosch | 215/11.5 |
| 3,924,620 | A | | 12/1975 | Seunevel | |
| 4,311,245 | A | | 1/1982 | Maffei | |
| 4,730,744 | A | * | 3/1988 | Vinciguerra | 215/11.5 |
| 4,821,896 | A | | 4/1989 | Cheng | |
| 4,828,126 | A | * | 5/1989 | Vincinguerra | 215/11.5 |
| 4,928,836 | A | * | 5/1990 | Wu et al. | 215/11.5 |
| 5,429,254 | A | | 7/1995 | Christine | |
| 5,607,074 | A | * | 3/1997 | De Gennaro | 215/11.5 |
| 5,688,238 | A | | 11/1997 | Moser et al. | |
| 5,692,627 | A | * | 12/1997 | Feng | 215/11.5 |

* cited by examiner

*Primary Examiner*—Lee Young
*Assistant Examiner*—Lien Ngo
(74) *Attorney, Agent, or Firm*—John Wiley Horton

(57) ABSTRACT

A nursing bottle with a vent located in its base. The vent is positioned so that the user can easily open it by pressing on it with a finger or thumb. The vent remains open only so long as it is pressed. Once released, a spring returns the vent to its closed position. The user may therefore set the bottle down without having to do anything to close the vent. The vent assembly may be easily removed from the bottle for thorough cleaning. An access notch is provided so that the user does not have to strain to reach the vent. Mounting features are included to position the notch in a right-handed or left-handed configuration.

1 Claim, 6 Drawing Sheets

NURSING BOTTLE WITH VENT

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of infant feeding. More specifically, the invention comprises a nursing bottle with a user-activated air vent.

2. Description of the Related Art

Prior art nursing bottles typically incorporate a pliable nipple assembly having a perforation through which the milk is drawn. One such prior art bottle is shown in FIG. 1. Bottle 10 is equipped with top thread 16 and base thread 18. Nipple assembly 12 screws on the top and base 14 screws on the bottom. Base 14 simply seals off the bottom of the bottle. It is provided to allow the user to open both ends of the bottle for cleaning—as any residual milk will sour and contaminate the bottle.

In operation, the infant sucks on the nipple and pulls liquid out of bottle 10. Of course, air must enter bottle 10 to displace this volume. In most bottles, the air can only enter through the nipple. This constraint means that air bubbles will be found in the milk in close proximity to the nipple. When the infant again sucks on the nipple, these small air bubbles will often be ingested. The ingestion of the air leads to colic and other gastrointestinal disorders. The unwanted ingestion of air is a long-recognized problem in infant feeding. Numerous prior art devices have proposed remedies to this problem.

A base-mounted vent is disclosed in U.S. Pat. No. 533,726 to McBride (1895). The McBride device incorporates a recessed base portion with a hole. A threaded plug resides in the hole. The venting mechanism is actuated by screwing the plug in or out. Of course, the plug must be screwed closed before setting the bottle upright. Otherwise, the milk will leak out the base. Those familiar with the art will know that infant feeding is a cumbersome operation. One arm must be used to support the infant, leaving only one hand free to manipulate the bottle. The threaded vent disclosed in McBride is therefore difficult to operate—especially since it must be turned in and out every time the bottle is set down.

A similar approach is disclosed in U.S. Pat. No. 2,094,721 to Puetz (1935). The Puetz device has a small hole in its base, into which a stopper is selectively pressed and removed. Although it does not require turning like the McBride device, the stopper must be completely removed to allow venting. It must then be held in the hand holding the bottle. It must also be replaced before setting the bottle down—obviously a cumbersome operation.

U.S. Pat. No. 1,976,450 to Lowe (1932) discloses a vent covered by a band of elastic material. A gripping feature is provided on the elastic material, so that the user can tug it clear of the vent when desired. The vent is located in the side of the bottle. While it is in an accessible position, the operation of the user tugging on the elastic material may also displace the elastic material so that it no longer covers the vent upon release. Thus, the device is prone to leakage (hence its disclosure that the vent hole should be made very small so as to minimize leakage).

Another side mounted vent is discloses in U.S. Pat. No. 2,066,445 to Allen (1934). Like McBride, the Allen device uses a threaded vent plug. The vent's location is somewhat more accessible than McBride. However, it is still necessary for the user to screw the plug in and out every time the bottle is set upright.

Another threaded vent is disclosed in U.S. Pat. No. 3,071,272 to Doner (1963). Although the vent is illustrated as being near the bottle's top—the text explains that it may also be located in the bottle's base. The '272 device suffers from the same cumbersome operation previously discussed.

Finally, a lever type vent is disclosed in U.S. Pat. No. 4,311,245 to Maffei (1982). The lever may be rotated through an arc of 180 degrees to open and close an air vent. The bottle also contains features for indicating the presence of an internal vacuum. The position and actuation of the lever is quite cumbersome, however, and the user must remember to close it before setting the bottle down.

The known devices are therefore limited in that they:

1. Require the manual closing of the vent every time the bottle is set down;

2. Are cumbersome to operate using only one hand; and

3. Are subject to leakage.

BRIEF SUMMARY OF THE INVENTION

The present invention comprises a nursing bottle with a vent located in its base. The vent is positioned so that the user can easily open it by pressing on it with a finger or thumb. The vent remains open only so long as it is pressed. Once released, a spring returns the vent to its closed position. The user may therefore set the bottle down without having to do anything to close the vent.

The vent assembly may be easily removed from the bottle for thorough cleaning. An access notch is provided so that the user does not have to strain to reach the vent. Mounting features are included to position the notch in a right-handed or left-handed configuration.

Accordingly, several objects and advantages of the present invention are:

1. To provide a device which does not require the manual closing of the vent every time the bottle is set down;

2. To provide a device which can be easily operated using only one hand; and

3. To provide a device which is not prone to leakage.

These objects and advantages will be fully explained in the details hereafter described, explained, and claimed, with reference being made to the accompanying drawings.

REFERENCE NUMERALS IN THE DRAWINGS

| | | | |
|---|---|---|---|
| 10 | bottle | 12 | nipple assembly |
| 14 | base | 16 | top thread |
| 18 | base thread | 20 | vent assembly |
| 22 | vent housing | 24 | vent bore |
| 26 | sealing flat | 28 | gasket |
| 30 | spring | 32 | notch |
| 34 | plunger | 36 | cylinder |
| 38 | gasket annulus | 40 | air passages |
| 42 | button | 44 | descending flange |

DETAILED DESCRIPTION OF THE INVENTION

Figure 1:
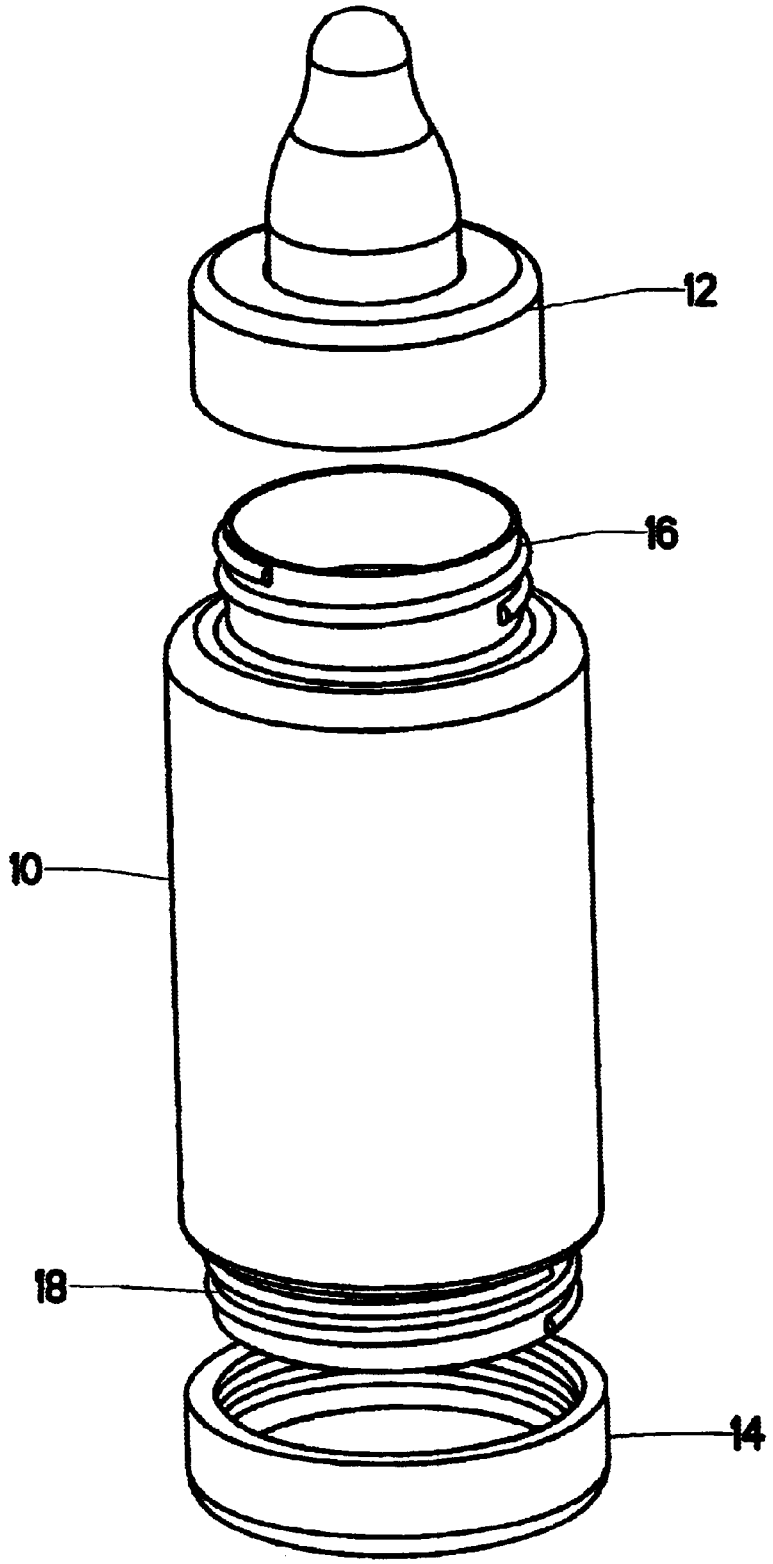
FIG. 1 is an isometric view, showing a prior art bottle.
Figure 2:
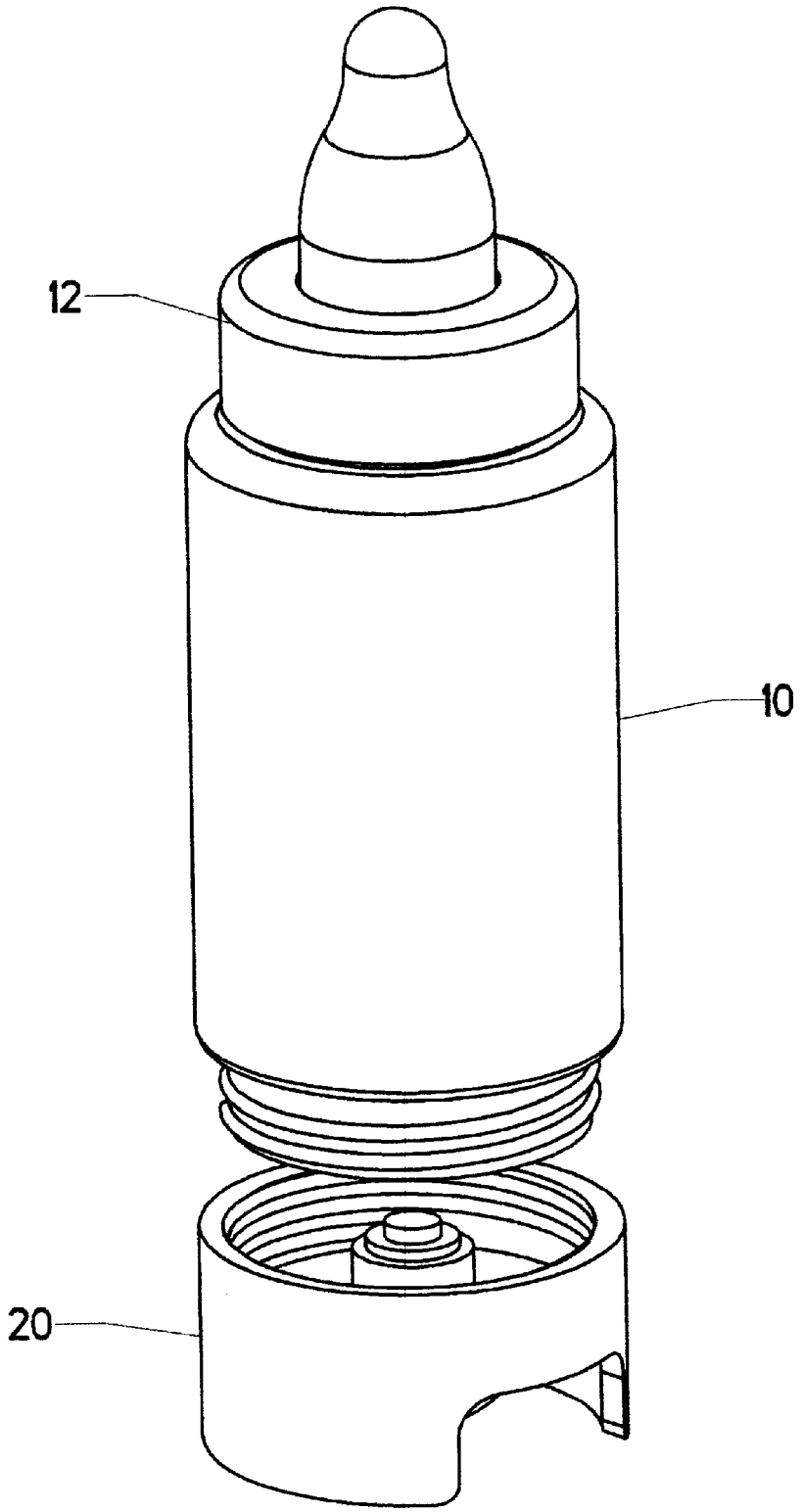
FIG. 2 is an isometric view, showing the proposed invention.

FIG. 2 shows the same type of nursing bottle as the one depicted in FIG. 1. However, vent assembly 20 has been substituted for base 14. Vent assembly 20 contains several novel features which will be discussed in detail. However, the reader should be aware that all these features could be incorporated into a bottle having a solid bottom. A detachable bottom is preferable only because it facilitates cleaning—just as for the prior art.

Figure 3:
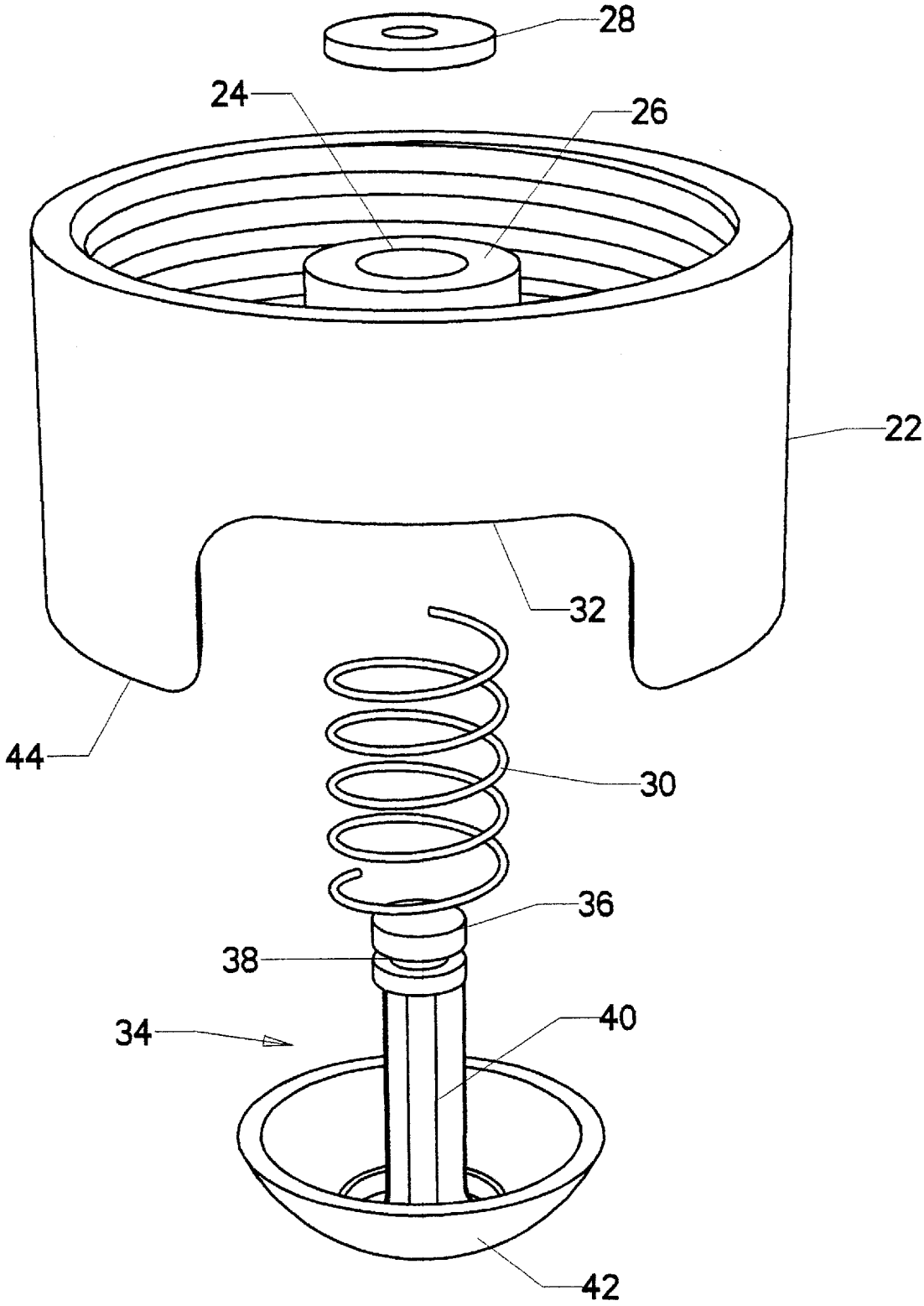
FIG. 3 is an isometric view, showing the vent assembly.

FIG. 3 is an exploded view showing the components of vent assembly 20. Vent housing 22 incorporates a female thread in its upper end, configured to engage base thread 14 on bottle 10. Vent bore 24 passes completely through vent housing 22. Seating flat 26 is formed on the upper surface of vent housing 22, surrounding vent bore 24.

Plunger 34 includes button 42 on its lower end and cylinder 36 on its upper end. Cylinder 36 opens into gasket annulus 38. Below gasket annulus 38, a series of air passages 40 lead down to button 42. To assemble vent assembly 20, the user first places spring 30 over cylinder 36. Next, the user pushes cylinder 36 through vent bore 24 until it protrudes above sealing flat 26 (having compressed spring 30). Then the user slides gasket 28—which is made of pliable material—down cylinder 36 until it seats in gasket annulus 38. The completed assembly is shown in FIG. 4.

Figure 4:
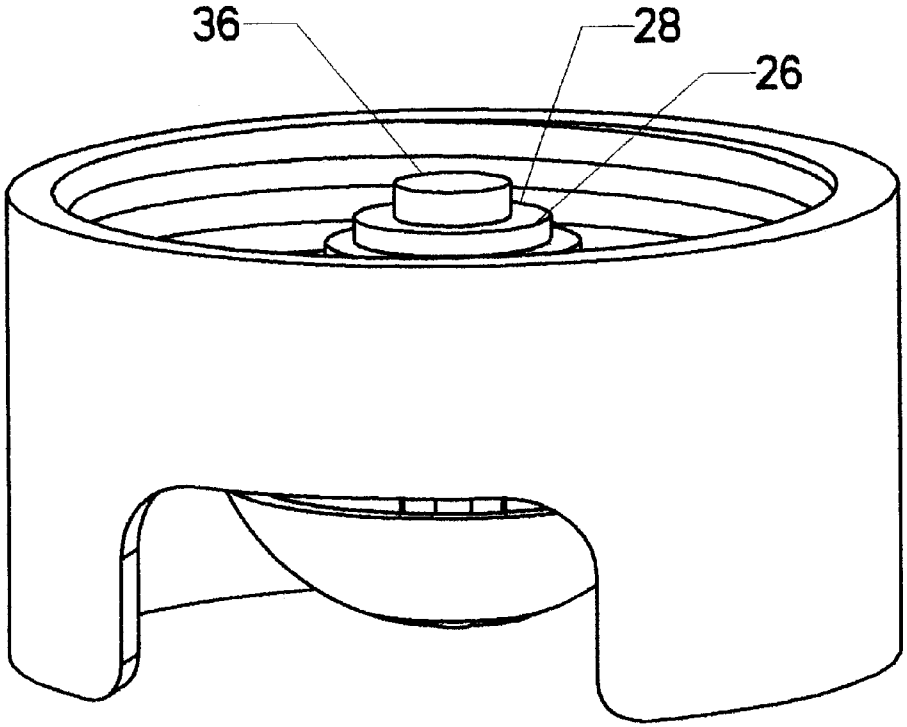
FIG. 4 is an isometric view, showing the vent in its closed state.

The reader will observe in FIG. 4 that gasket 28 is pulled down against sealing flat 26, creating a seal which will not leak either fluid or air. Vent assembly 20 is then threaded onto bottle 10, and the bottle is ready for use. To disassemble the invention, the steps heretofore described are simply reversed.

Figure 5:
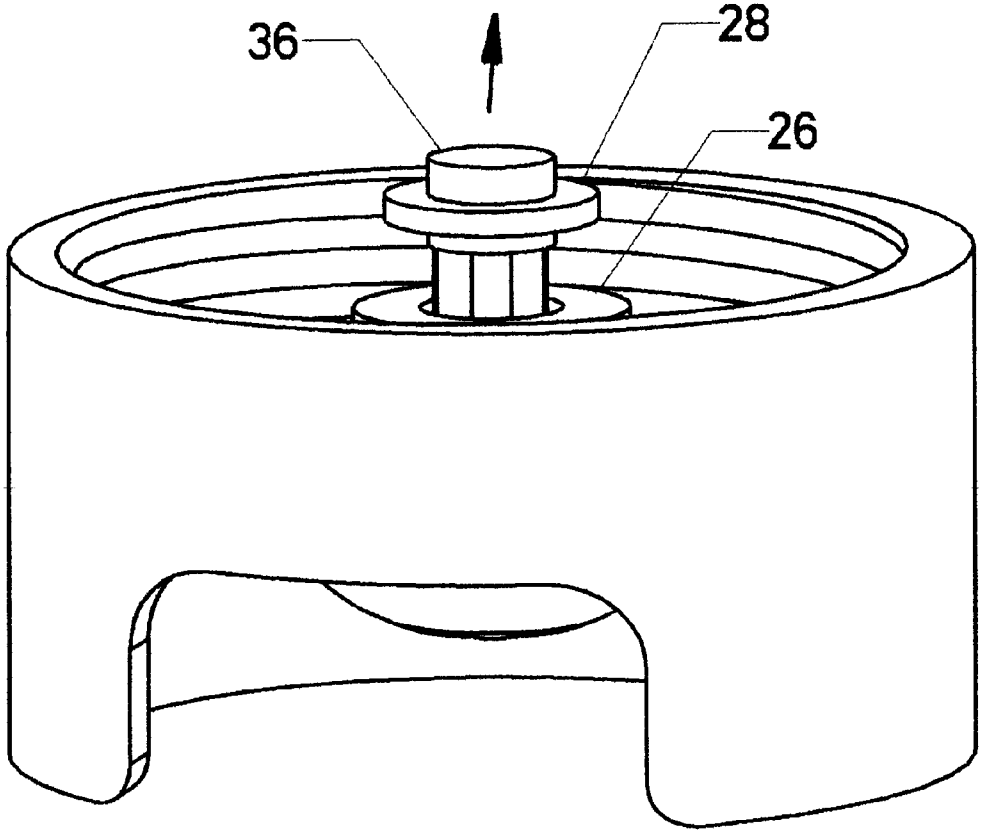
FIG. 5 is an isometric view, showing the vent in its open state.

To vent bottle 10, the user pushes button 42 on plunger 34. FIG. 5 shows plunger 34 pushed upward, with the result that gasket 28 has lifted clear of sealing flat 26. In this position, air passages 40 are connected to the hollow interior of the bottle.

It is of course necessary for the bottle to be able to perform all its other prior art functions. It is common for a nursing bottle to be set down on a flat surface. It is therefore necessary for the bottle to be able to stand on its base. Returning now to FIG. 3, the reader will observe that vent housing 22 incorporates descending flange 44 around its perimeter. Descending flange 44 actually supports the bottle when it is set upon its base, preventing the accidental activation of plunger 34. If plunger 34 is activated when the bottle is in such a position, the contents will leak out.

While descending flange 44 does protect button 42, it also tends to prevent the user from activating button 42. Accordingly, notch 32 is provided to allow the access of the user's thumb or finger.

Figure 6:
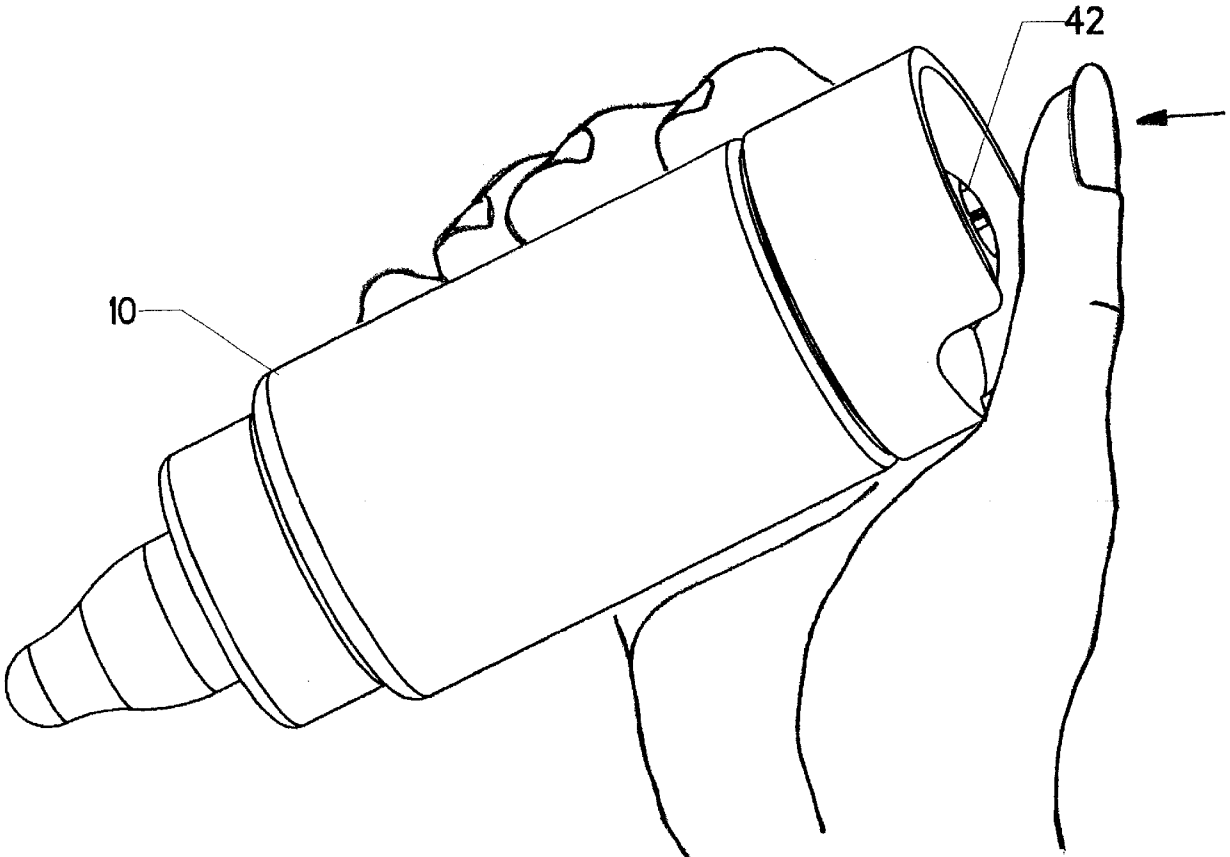
FIG. 6 is an isometric view, showing the operation of the invention.

Turning now to FIG. 6, the operation of the invention will be described. Spring 30 ensures that vent assembly 20 remains closed except when activated. When the user needs to feed an infant, the user picks up bottle 10 and partially inverts it to the conventional position, as shown. The user then monitors the infant sucking on the nipple. The user then selectively activates button 42 with his or her thumb or finger. In this manner, the vacuum within the bottle can be eliminated, or selectively reduced.

Those skilled in the art will know that some bottles now have a canted nipple assembly 12, which some believe makes the bottle easier to hold. If such a bottle is employed, then the position of notch 32 will need to be altered depending on whether the user is right-handed or left-handed. This alteration could be accomplished in many ways. As one example, descending flange 44 could be attached to vent housing 22 in such a manner as to allow it to slide around. This would necessitate the use of two separate parts, however.

Another approach is to use a double thread on bottle 10 and vent housing 22. A double thread incorporates two separate threads which are nested together. The starting point for the second thread is indexed 180 degrees from the first. Thus, vent housing 22 will thread onto base thread 18 in two separate positions, separated by 180 degrees of rotation. This feature would allow notch 32 to be placed in the correct position without requiring the use of two separate parts. Accordingly, this approach represents the preferred embodiment.

The reader will therefore appreciate that the proposed invention can greatly reduce the ingestion of air during infant feeding. The invention has additional advantages in that it:

1. Does not require the manual closing of the vent every time the bottle is set down;
2. Can be easily operated using only one hand; and
3. Is not prone to leakage.

Although the preceding descriptions convey significant detail about the invention, they should not be construed as limiting the scope of the invention, but rather as providing illustrations of the preferred embodiment. As an example—the use of a separate threaded assembly for attaching the purge valve is simply one of expedience. The features needed to mount the purge valve could easily be incorporated in the bottle itself. Accordingly, the scope of the invention should be fixed by the following claims, rather than by the examples given.

Having described my invention, I claim:

1. A nursing device allowing a user to feed an infant a liquid, comprising:

a. a bottle, defining a hollow inner chamber for containment of said liquid, and having a first end and a second end;

b. a nipple, proximate said first end, wherein said nipple is pierced by an opening so that said infant can suck said liquid through said nipple;

c. a vent bore, proximate said second end of said bottle;

d. a plunger, located within and moveable within said vent bore, including a sealing gasket positioned proximate said bottle and a button positioned outside said bottle in a location readily accessible to said user;

e. biasing means, positioned so as to bias said plunger to a position wherein said sealing gasket seals said vent bore unless said user presses said button;

f. wherein said second end of said bottle has a perimeter, and a descending flange extending from said perimeter so as to encircle and protect said button of said plunger, so that said button is not accidentally pressed when said second end of said bottle comes into contact with other bodies; and g. a notch, cut through said descending flange, thereby allowing said user to more easily reach said button.

* * * * *